US007617592B2

(12) United States Patent
Rayl et al.

(10) Patent No.: US 7,617,592 B2
(45) Date of Patent: Nov. 17, 2009

(54) METHOD FOR MANUFACTURING THIN FILM HEATERS

(75) Inventors: Kraig Rayl, Logansport, IN (US); Alan Study, Carmel, IN (US)

(73) Assignee: Total Electronics, LLC, Logansport, IN (US)

( * ) Notice: Subject to any disclaimer, the term of this patent is extended or adjusted under 35 U.S.C. 154(b) by 319 days.

(21) Appl. No.: 11/301,151

(22) Filed: Dec. 12, 2005

(65) Prior Publication Data

US 2007/0007267 A1 Jan. 11, 2007

Related U.S. Application Data

(60) Provisional application No. 60/697,745, filed on Jul. 8, 2005.

(51) Int. Cl.
*H05B 3/00* (2006.01)

(52) U.S. Cl. ..... 29/611; 29/620; 29/621; 29/825; 29/829; 29/874; 219/217; 219/528; 219/543; 427/122; 427/123; 427/125

(58) Field of Classification Search ..... 29/611, 29/620, 621, 825, 829, 814; 101/150, 151, 101/153, 170, 181; 219/217, 528, 543; 427/122, 427/123, 125

See application file for complete search history.

(56) References Cited

U.S. PATENT DOCUMENTS

| | | | | |
|---|---|---|---|---|
| 4,401,686 | A | 8/1983 | Durand | |
| 4,479,432 | A | 10/1984 | Masaki et al. | |
| 5,690,028 | A * | 11/1997 | Schick | 101/211 |
| 5,758,575 | A | 6/1998 | Isen et al. | |
| 6,026,748 | A | 2/2000 | Reed et al. | |
| 6,770,848 | B2 | 8/2004 | Haas et al. | |
| 6,824,857 | B2 | 11/2004 | Lochun et al. | |
| 6,884,965 | B2 | 4/2005 | Nelson et al. | |
| 2005/0051536 | A1 | 3/2005 | Shirlin et al. | |

* cited by examiner

*Primary Examiner*—Thiem Phan
(74) *Attorney, Agent, or Firm*—Woodard, Emhardt, Moriarty, McNett & Henry LLP

(57) ABSTRACT

According to one embodiment of the present invention, a method for manufacturing thin film heaters includes an automated process for applying at least one layer of ink to a conductive substrate, and forming at least one electrically conductive electrode in electrical communication with the substrate by curing the ink. When an electrical current is applied to the thin film heater, current flowing through the substrate generates heat in the substrate. In alternate embodiments, a flexographic printing process is used to overlay two similar layers of ink on a carbon impregnated substrate and cure the ink to form at least one electrode conductor.

23 Claims, 9 Drawing Sheets

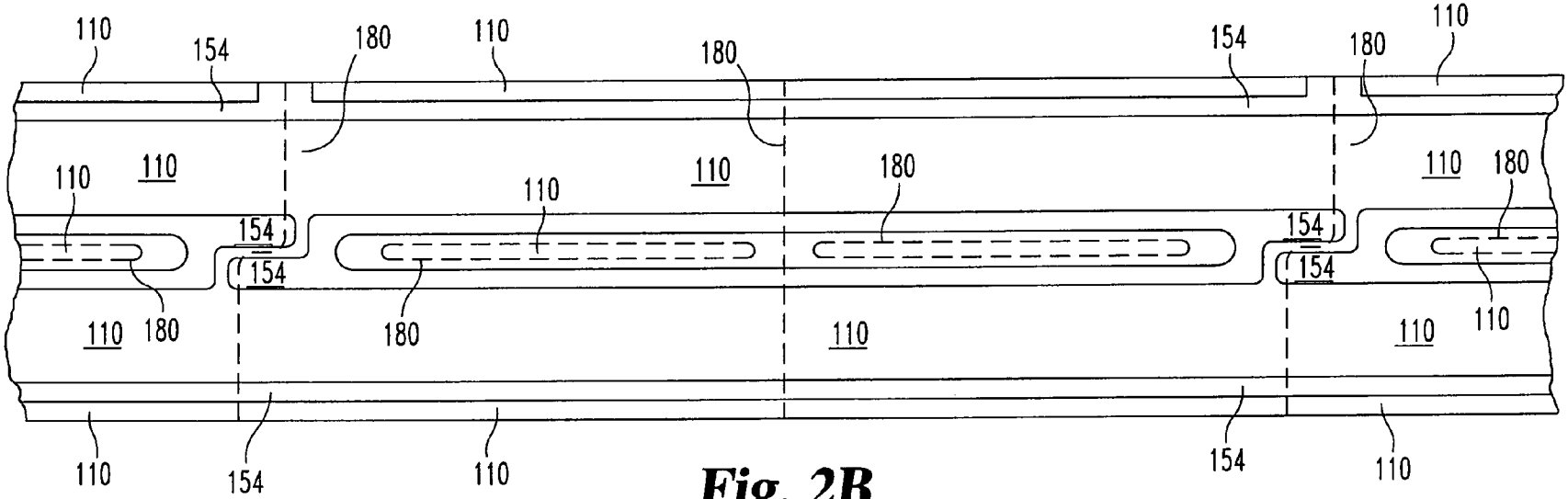
110
180
154
110
180
154
110
180
154

METHOD FOR MANUFACTURING THIN FILM HEATERS

This application claims the benefit of U.S. Provisional Application No. 60/697,745, filed Jul. 8, 2005, the entirety of which is hereby incorporated herein by reference.

FIELD OF THE INVENTION

The present invention relates generally to heating applications. In particular, the invention relates to a method and apparatus for manufacturing conductive thin film heaters.

BACKGROUND OF THE INVENTION

Foil based film heaters, for example copper foil based heaters, have been in use for various heating applications, for example, pressure sensitive surface heating applications. However, foil based thin film electrodes are prone to catastrophic failure due to puncture, fatigue and internal shorting. Reactive metal failures in foil based film heaters have also been present due to outgassing of urethane foam byproducts, resulting in rapid corrosion and degradation of load carrying conductor metal.

In light of these and other shortcomings in foil based film heaters, thin film composite and low density electrode heater designs were developed. One such design for a flexible film based heater includes a conductive carbon film substrate, such as carbon impregnated Kapton® (manufactured by E.I. du Pont de Nemours and Company), with conductive electrodes, such as printed silver electrodes, located on top of and in electrical communication with the conductive substrate. This design is useful for various applications, such as those associated with the automotive industry, for example, seat heaters, mirror heaters, and fluid reservoir (such as water tank) heaters. Electrical current flows through the electrodes and through the conductive substrate. Heat is generated as electricity flows through the substrate due to the resistance of the substrate. One particular application is, for example, a seat heater that conforms with Daimler Chrysler specification number CN 40715-V01-AC.

The conductive carbon film substrate with conductive electrodes design has demonstrated an improved resistance to thermal and mechanical degradation under general operating conditions over the foil based heaters. Other advantages realized by flexible film based heaters include, but are not limited to: reduced weight, lower electrical power requirements, and improved thermal transmission properties. Additionally, film based heaters tend to resist perforations, resist cracking and withstand a large number of puncture sites without creating a thermal incident failure of the thin film structure, and flexible film based heaters exhibit these characteristics over a wide range of operating conditions. As an example, when a film based heater is perforated, the perforation results in reduced thermal energy output, with the output reduction being proportional to the extent of puncture. Generally, as compared to foil based heaters, film based heaters are intrinsically safer and not as prone to catastrophic failure even when used in active flexing or extreme temperature applications. Film based heaters are typically compatible with dissimilar metal configurations, situations involving chemical out-gassing or perforation degradation, and do not typically result in non-conforming thermal incidents.

Known manufacturing methods for film based heaters have been limited to slow, non-automated processes. One reason for this limitation was the belief that automated processes could not apply a sufficiently thick layer of conductive ink to the substrate to generate an operable heater electrode. One known method for manufacturing the film based heaters is a silk screen transfer printing process that deposits a silver ink onto a conductive substrate, such as carbon impregnated Kapton®. The ink is forced by a rubber blade, generally handheld, through a mesh stencil, or screen, onto an individual piece of substrate. Once a piece of substrate is printed and removed from the printing press, another piece of substrate is inserted into the printing press to have ink applied. Following printing, each piece of printed substrate is individually sent through a drier to complete the process. The silk screen method is capable of achieving minimum silver ink thickness requirements and was the method recommended by engineers of the company producing the carbon impregnated Kapton® substrate that was used in the known silk screen manufacturing method as the only acceptable method of silver ink application. These engineers further considered the use of highly automated transfer printing of silver ink deposits on carbon impregnated sheeting as being generally impossible.

The silk screen technique, however, has a number of shortcomings. For example, the silk screen method is too slow to be commercially viable, especially for many large scale production purposes. As another example, the silk screen method is prone to inconsistencies between applications due to differences in how the ink spreads from one application to another.

Consequently, there is a need for an improved manufacturing method and apparatus for a film based heater. Certain preferred features of the present invention address these and other needs, and provide other important advantages. Some or all of these features may be present in the corresponding independent or dependent claims, but should not be construed to be a limitation unless expressly recited in a particular claim.

SUMMARY OF THE INVENTION

One example embodiment of the present invention provides a method for manufacturing a flexible heater. The method includes providing a supply of flexible and electrically conductive substrate and a liquid ink. The substrate advances to a first printing location, a first layer of ink is applied in a first pattern to the substrate at the first printing location and the first layer of ink is partially cured by heat. Additionally, the substrate advances to a second printing location which is different from the first printing location and a second layer of ink is applied in a second pattern to the substrate at the second printing location. The second layer of ink substantially overlies the first layer of ink. The method further includes fully curing the first and second layers of ink with heat. The fully cured first and second layers of ink are electrically conductive, and the substrate, the fully cured first layer of ink, and the fully cured second layer of ink are in electrical communication.

Another example embodiment of the present invention provides a method for manufacturing a flexible heater which includes providing a supply of flexible and electrically conductive substrate and a liquid ink. The substrate advances to a first printing location and a first layer of ink is applied in a first pattern to the substrate at the first printing location using a flexographic printing technique, and the first layer of ink is partially cured with heat. The substrate is advanced to a second printing location which is different from the first printing location and a second layer of ink is applied in a second pattern to the substrate at the second printing location using a flexographic printing technique. The second layer of ink substantially overlies the first layer of ink. The method further includes fully curing the first and second layers of ink with heat. The fully cured first and second layers of ink are electrically conductive, and the substrate, the fully cured first layer of ink, and the fully cured second layer of ink are in electrical communication.

Still another example embodiment of the present invention provides a method for manufacturing a flexible heater, which includes providing a supply of flexible and electrically conductive substrate and a liquid ink. The substrate is advanced to a first printing location and a first layer of ink is applied in a first pattern to the substrate at the first printing location using a flexographic printing technique and at least one anilox roll, the first layer of ink is partially cured with heat. The substrate is advanced to a second printing location, which is different from the first printing location, and a second layer of ink is applied to the substrate at the second printing location using a flexographic printing technique and at least one anilox roll. The second layer of ink substantially overlies the partially cured first layer of ink fully. The method further includes curing the first and second layers of ink with heat. The fully cured first and second layers of ink are each electrically conductive, and the substrate, the fully cured first layer of ink, and the fully cured second layer of ink are in electrical communication.

BRIEF DESCRIPTION OF THE DRAWINGS

FIG. 2B is a top plan view of the substrate depicted in FIG. 2A with perforations.

DETAILED DESCRIPTION OF THE ILLUSTRATED EMBODIMENTS

Figure 1:
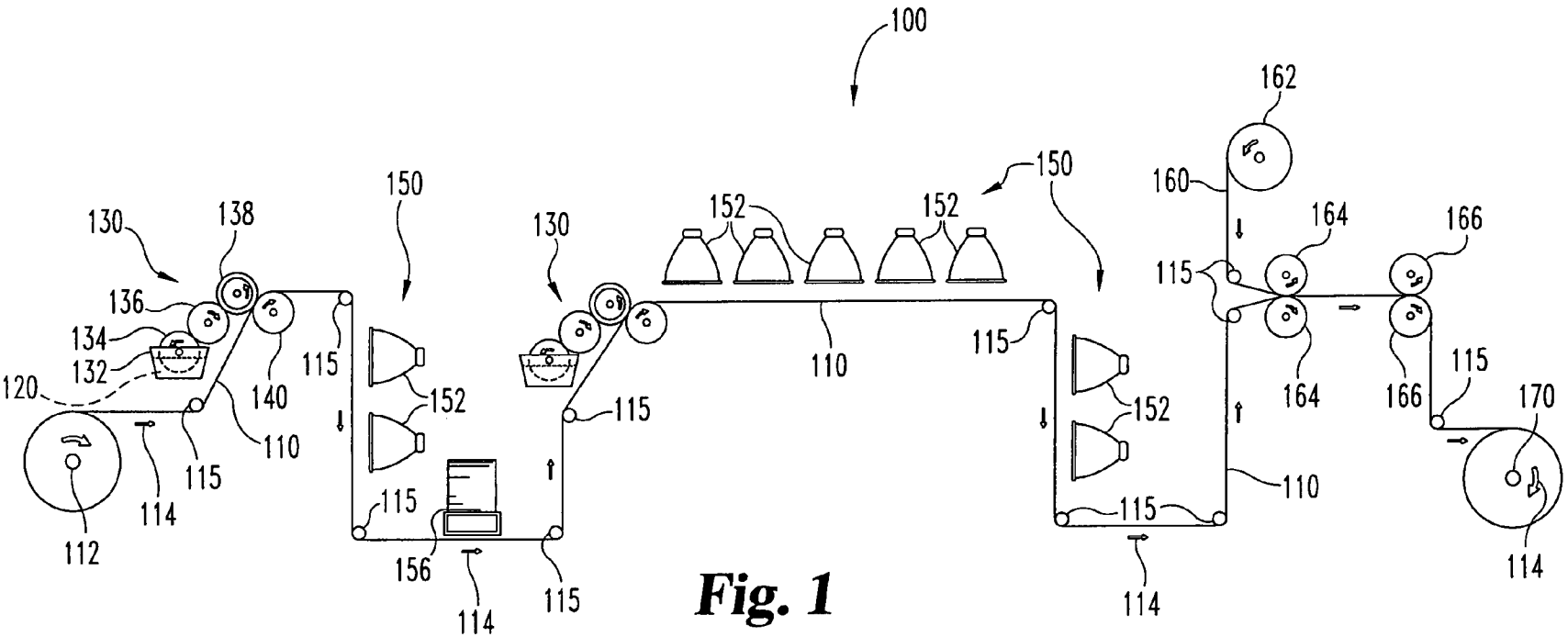
FIG. 1 is a side elevational view of a manufacturing method and apparatus for a flexible heating element according to one embodiment of the present invention.

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

In the illustrated embodiments, the present invention provides a method and apparatus for manufacturing flexible film heaters. In general, the flexible heaters include at least one conductive substrate with at least one electrode conductor. In other embodiments, the electrode conductor is adjacent to and in electrical communication with the conductive substrate where electrical current flows through the electrode conductors and through the conductive substrate. Heat is generated as electricity flows through the substrate due to the resistance of the substrate. Alternate embodiments of the flexible heaters have at least one electrode on a carbon film substrate and an adhesive backed liner used to secure the heater to an object.

One example flexible film heater produced by embodiments of the present invention includes a carbon impregnated conductive substrate with at least one silver ink surface electrode trace on the substrate surface. Other embodiments include at least one conductive trace contained in the substrate. The silver ink electrodes generally provide continuous circuit continuity and thermal stability, resist flaking and cracking under expansion, and provide extended electrode life and low mean-time-between-failures.

Example embodiments of the current invention include automated printing techniques, for example a flexographic printing process with at least one anilox roll, for manufacturing the thin film heaters. The term flexographic refers to a process of rotary letterpress using flexible plates. One example of a flexographic process is a process whereby a printable material, for example a liquid ink, is transferred from a reservoir to a transfer cylinder, and where the transfer cylinder (for example an Anilox roll) deposits a measured amount of ink on an application cylinder (for example a plate cylinder), and where the application cylinder depots the printable material on the substrate. As used herein, term flexographic does not include a silk screen process. Other embodiments utilize other conventional offset or positive transfer printing techniques with the particular method employed based on the desired electrode geometry.

In one embodiment of the present invention, two layers of a conductive material, one on top of the other, are consecutively printed in similar patterns on top of a flexible conductive substrate material. Silver ink is an example conductive material that is layered on the substrate. Carbon impregnated polyimide film, such as carbon impregnated Kapton®, is an example conductive substrate. The process uses a roll of substrate and continually prints the conductive ink in a repeating pattern on the substrate. A first application of conductive ink is partially cured using heat lamps. A second layer of conductive ink is applied in a similar pattern as the first layer and printed directly on top of the first layer. After the second layer is applied, both layers are fully cured using heat lamps. The curing process is sensitive to variations in, for example, the temperature of the heat lamps, the distance between the heat lamps and the substrate, and the time that the printed material is exposed to the heat lamps. In general, the curing process is difficult to optimize and is, at least in part, a limitation to how fast the printing process may be performed.

Depicted in FIG. 1 is a manufacturing apparatus and method 100 according to one embodiment of the present invention. Manufacturing apparatus and method 100 comprises conductive substrate 110 which is wound in a coil about supply spool 112 and travels in travel direction 114 as it unwinds. In the illustrated embodiment, substrate 110 moves in travel direction 114 at approximately 50-80 feet per minute. In other embodiments, substrate 110 moves at approximately 80 feet per minute or greater, while in still further embodiments substrate 110 moves at approximately 50 feet per minute or less.

As substrate 110 unwinds from spool 112, substrate 110 travels around guide cylinder 115 and into an applicator, for example, printer 130, where ink 120 is applied to substrate 110. In the illustrated embodiment, a flexographic type printer is used. This type of printer is suitable to apply sufficiently thick layers of ink 120 for the present invention, although other embodiments may utilize other types of printers that are capable of applying sufficiently thick layers of ink 120. Ink 120 comprises a conductive material, for example silver, and a suspension solution, for example a thinner, to suspend the conductive material. In alternate embodiments, the ink is comprised of other materials, such as high metal loaded polymerized printed inks. In still other embodiments, conductive tapes and films are used.

Printer 130 includes ink container 132, a pick-up cylinder, for example, fountain roll 134, a transfer cylinder, for example, anilox roll 136, an application cylinder, for example, plate cylinder 138, and impression cylinder 140. Fountain roll 134 draws ink 120 from ink container 132 and deposits ink 120 on anilox roll 136. Anilox roll 136 in turn deposits a measured amount of ink 120 on plate cylinder 138. Plate cylinder 138 deposits a layer of ink 120 in a pattern onto substrate 110, which is pressed against plate cylinder 138 by impression cylinder 140. The ink pattern on the substrate repeats at least as a function of the size of plate cylinder 138, where plate cylinders 138 with larger diameters allow longer patterns of ink 120 to be deposited on substrate 110. Plate cylinder 138 and impression cylinder 140 are driven by a motor and function as a transport mechanism for substrate 110. Other embodiments have various components of manufacturing apparatus and method 100 driven, either individually or in various combinations, to function as a transport mechanism for substrate 110, for example, supply spool 112, guide cylinders 115, plate cylinder 138, impression cylinder 140, pressure cylinder 164, and take-up spool 170.

As substrate 110 travels beyond printer 130 and around another guide cylinder 115, conductive substrate 110 with a first printed layer of ink 120 enters a curing device, for example, dryer 150. In the depicted embodiment, dryer 150 includes approximately two lamps 152 positioned approximately 2½-3 inches from the surface of substrate 110 with ink 120. Dryer 150 heats the substrate to approximately 375 degrees Fahrenheit and partially cures the first layer of ink 120. Other embodiments use one, three, or more lamps, while other embodiments heat the substrate to temperatures in excess of 1000 degrees Fahrenheit. Still other embodiments do not substantially change the temperature of the substrate from that used when ink 120 is applied. Further embodiments position the curing device at other distances from the substrate, such as from 0 inches (touching) to a number of feet away from the substrate.

Lamps 152 comprise T3 quartz lamps with a wavelength of approximately 1.15 microns and an output potential of approximately 4,000 degrees Fahrenheit at 500 watts. Other embodiments utilize alternate types of lamps, while still other embodiments utilize other curing devices, for example, gas and electric heaters, either in direct or indirect contact with substrate 110.

After traveling past dryer 150, substrate 110 travels past an excess particle remover, for example, blower 156, which removes any dust or debris prior to entering the second printer 130. Other embodiments use one, three, or more excess particle removers located at various positions along substrate 110.

The second printer 130 deposits a second layer of ink 120 on top of the first layer of partially cured ink 120 in a pattern that substantially overlies the first layer of ink 120. Other embodiments deposit a second layer of ink 120 in a substantially similar pattern as the first layer of ink 120. Further embodiments deposit a second layer of ink in a pattern that differs from the first layer of ink and in locations that may differ from the first layer of ink. Still other embodiments of the present invention utilize only one printer 130 and deposit only one layer of ink 120 on substrate 110, while other embodiments utilize at least three printers 130 and deposit at least three layers of ink 120 on substrate 110.

Following application of the second layer of ink 120, conductive substrate 110 travels past a second dryer 150. The second dryer 150 includes approximately seven lamps 152 that fully cure the first and second layers of ink 120. In the depicted embodiment, the seven lamps 152 are positioned approximately 2½-3 inches from the surface of substrate 110 with ink 120. The second dryer 150 heats the substrate to approximately 375 degrees Fahrenheit and fully cures the two layers of ink 120. Other embodiments the second dryer 150 comprises use six or fewer lamps, while in still other embodiments the second dryer 150 comprises at least eight lamps. In yet further embodiments, the second dryer 150 heat the substrate to temperatures in excess of 1000 degrees Fahrenheit. Still other embodiments do not substantially change the temperature of the substrate from that used when ink 120 is applied. Further embodiments position the curing device at other distances from the substrate, such as from 0 inches (touching) to a number of feet away from the substrate.

The suspension solution in ink 120 is eliminated or altered as ink 120 is fully cured leaving primarily elemental silver after the curing process. The fully cured layers of ink 120 form electrode conductors 154. Ink 120 is not conductive prior to curing, and is conductive after being fully cured. In alternate embodiments, ink 120 is conductive before curing.

According to the depicted embodiment, the first layer of ink 120 is partially cured by the first dryer 150 and both layers of ink 120 are fully cured by the second dryer 150. Partially curing the first applied layer of ink 120 before applying the second layer of ink 120 allows blending and increased conductivity between the two layers while providing for an increase in the overall thickness of ink 120. In the illustrated embodiment, the first layer of ink 120 becomes partially tacky when it is partially cured. Other embodiments fully cure the first layer of ink 120 before application of the second layer of ink 120. In general, the total number of layers of ink 120 and the point at which each layer is fully cured may be varied depending on, for example, the specific ink, electrode pattern and substrate used, in order to produce optimum results.

During the curing process ink 120 typically compresses, requiring initial application of a thicker layer of ink 120 than is required after full curing. More completely curing ink 120 results in a more compact trace of silver ink and typically results in better conductivity throughout the cured silver ink. The total thickness of the fully cured two layers of silver ink is approximately 5 mils. In alternate embodiments, the thickness of the fully cured two layers of silver ink is between approximately 4 and 6 mils. In other embodiments, the thickness of the fully cured two layers of silver ink is between approximately 3 and 7 mils, while in still other embodiments the thickness of the fully cured two layers of silver ink is between approximately 3 and 10 mils.

After both layers of ink 120 are fully cured, adhesive layer 160, which is drawn off of supply spool 162, in pressed onto substrate 110 with pressure cylinders 164. In the illustrated embodiment, adhesive layer 160 is applied to the surface of conductive substrate 110 on which electrode conductors 154 are applied. Adhesive layer 160 insulates and protects electrode conductors 154 from foreign objects. Other embodiments apply adhesive layer 160 to the surface of conductive substrate 110 that does not have electrode conductors 154 applied. In the illustrated embodiment, adhesive layer 160 comprises 3M Part No. 467 MP adhesive backing and is approximately 0.50 mils thick with an approximately 3.0 mil thick release liner releasably attached to the adhesive layer, although other embodiments utilize other suitable adhesive layers and release liners.

After application of adhesive layer 160, conductive substrate 110 travels through a cutting device, for example, rotary steel rule die 166, which perforates substrate 110 into separable portions, where the portions remain connected while allowing substrate 110 to be easily separated into the specified portions at a later time. The separating of substrate 110 may be performed by hand or by a machine. In the illustrated embodiment, steel rule die 166 perforates substrate 110 in lengths corresponding to one complete pattern of ink 120 on substrate 110. Substrate 110 may be perforated in any length appropriate for a particular application, for example, in some embodiments, steel rule die 166 perforates substrate 110 in lengths corresponding to at least two complete patterns of ink 120 on substrate 110, while in still other embodiments, steel rule die 166 perforates substrate 110 in lengths corresponding to a fraction of one complete pattern of ink 120 on substrate 11. Other embodiments do not utilize a cutting device, while still other embodiments or utilize a cutting device that completely cuts conductive substrate 110 into specified lengths. In the illustrated embodiment, the perforated conductive substrate 110 is rolled, or wound in a coil, about take-up spool 170.

Figure 2A:
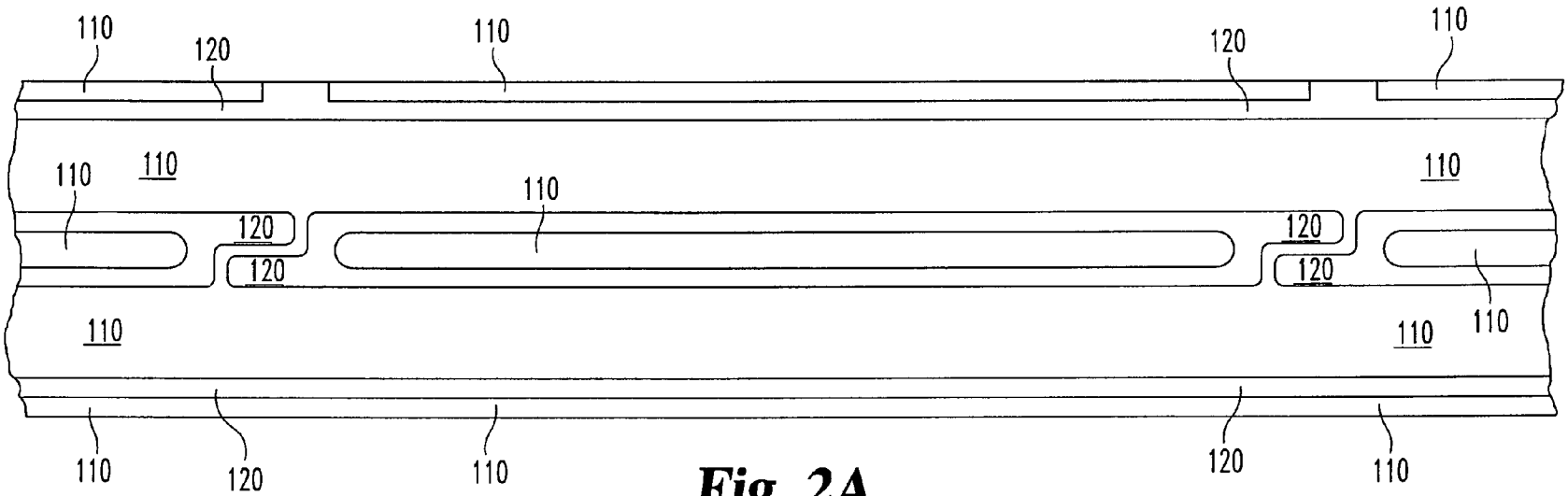
FIG. 2A is a top plan view of a substrate with an ink pattern manufactured according to the embodiment depicted in FIG. 1.

Illustrated in FIG. 2A is conductive substrate 110 with an example pattern of ink 120 layered on the surface of substrate 110. After being fully cured, ink 120 forms electrode conductors 154 (FIG. 2B), which are in electrical communication with conductive substrate 110. The ink pattern is repetitive along substrate 110 in lengths that are appropriate for the desired application. FIG. 2B depicts conductive substrate 110 after steel rule die 166 perforates conductive substrate 110 into shapes usable for the construction of a flexible film heater.

In the illustrated embodiment, substrate 110 comprises a carbon impregnated film approximately 2 mils thick. In alternate embodiments, substrate is approximately 1 to 3 mils thick, while in still other embodiments, substrate 110 is approximately 1 to 5 mils thick. The substrate 110 is impregnated with carbon during the manufacturing process by, for example, first grinding or machining an active form of carbon black, or other conductive or semi-conductive element, and suspending the carbon particles in the substrate 110. An example substrate used in the illustrated embodiment is DuPont Kapton®, Part No. 200RS60. In other embodiments, substrate 110 comprises other forms of dielectric film in various thicknesses, where the dielectric film may or may not be extruded. In still other embodiments, substrate 110 comprises a dielectric substrate with at least one surface coated with a conductive or semi-conductive material, although this embodiment may degrade with use faster than a substrate impregnated with a conductive or semi-conductive material due to the material either sloughing or delaminating from the substrate.

Inconsistencies may occur in the conductive and/or resistive properties of conductive substrate 110, which can adversely affect the performance of the thin film heater. These inconsistencies may result in significant variations in resistivity between batches or between the beginning and the end of a single spool of substrate 110. To compensate for these inconsistencies, the pattern of ink 120 applied to substrate 110 may be changed. For example, the ink pattern may place the electrode conductors relatively close together for one particular batch of conductive substrate with a relatively high resistivity, and the ink pattern may be changed to place the electrode conductors farther apart for a batch of conductive substrate with relatively lower resistivity.

In one example embodiment, a continuity test is performed after fully curing ink 120. The continuity test determines the resistance of the substrate between two electrode conductors, indicating whether the conductor electrodes have been positioned appropriately for the resistivity of current batch of conductive substrate 110. The test is also useful for determining whether ink 120 was properly cured. An example device for performing this test utilizes a four lead Kelvin connector.

In the illustrated example embodiment, ink 120 comprises a heavily loaded silver based polymer thick film ink in which elemental silver is suspended in a liquid solution, such as a polymer ink binder, for example. In other embodiments, ink 120 suspends other types of conductive particles. The liquid suspension of the silver facilitates printing the silver onto a substrate. The silver, or other conductive particle, is generally manufactured using conventional electrochemical and/or mechanical methods to produce silver rods (hollow or solid) and/or silver fibers. An example ink used in the illustrated embodiment is DuPont® Silver Conductive Paste, Part No. 5025. In alternate embodiments, the ink may be further reduced by adding suspension solution or thinner, for example, DuPont® Thinner, Part No. 8210.

Prior to the present invention, engineers in the field, for example, those employed by the manufacturer of the conductive substrate and ink, believed flexible film heaters could not be produced using an automated process. This skepticism was at least in part based on the belief that an automated process was incapable of applying a sufficiently thick layer of conductive ink to carry the required current load for a heater. Previous testing using heaters produced by a screen printing process indicated that thinner layers of applied ink 120 had a decreased ability to carry the required current load. However, it was discovered that ink layers sufficiently thick to carry the necessary current load were able to be applied to a substrate using different methods. Furthermore, it was discovered during testing of the illustrated embodiment that the total thickness of cured ink 120 required to produce flexible film heaters using the illustrated method and apparatus was less than, and approximately one-third, the minimum total thicknesses believed to be required using prior methods, such as silk screening.

Other embodiments of the present invention include at least a minimal first layer deposit of the printed conductor metals with a locally high density of conductor metal at the carbon film interface. In still other embodiments, multiple thin coatings are used in order to maximize the reaction rate of deposited metallization (compressed silver resistively per unit volume) and to minimize silver ink consumption. To achieve stable coatings of this type, design criteria, such as the conductor width surfaces or segmented connector joints, require consideration.

Various forms of thin film heaters produced by embodiments of the present invention include sheets, rods, cylinders, fibers, and any form applicable to heater dissipation and temperature control. Still other embodiments produce conductive articles that include, for example, a plurality of thin conductive layers with differing metals in adjacent layers, which have large differences in energy level, and which simultaneously allow use with other applications including Thermopile, Integrated Electronics and Photo-voltaic applications using similar technologies and materials.

In the illustrated embodiment, the speed at which substrate 110 travels is at least in part limited by the curing process, although the speed at which ink 120 is printed on substrate 110 is appreciably faster than previously known methods. As an example, the previously known silk screen printing process for manufacturing heaters used a large oven heated to approximately 175 degrees and required substantially more time, approximately 15 minutes, to cure the printed ink than that required for the illustrated embodiment, approximately 10 seconds. In fact, engineers for the company manufacturing the conductive substrate and ink were doubtful that the ink could be cured as rapidly as is realized with the illustrated embodiment.

Although the speed at which substrate 110 travels as ink 120 is cured may be increased by increasing the heat generated by dryers 150, the exact relationship between the temperature of dryers 150 and the speed of conductive substrate appears to be somewhat unpredictable and adding an increment of heat does not necessarily result in the ability to increase speed a corresponding increment.

One characteristic of ink 120 is that the silver particles are abrasive and can quickly wear down an anilox roll. To compensate for the abrasive properties of ink 120, anilox roll 136 in the illustrate embodiment is a ceramic-type of anilox roll that tends to resist these abrasive properties better than the chrome anilox rolls, for example, an anilox reverse technology (ART) roll. Other embodiments utilize different types of anilox rolls, such as laser engraved and chrome anilox rolls.

In the illustrated embodiment, the anilox roll 136 used to apply the first layer of ink 120 has an anilox roller volume of approximately 31 billion cubic microns ("bcm") that results in approximately 70% coverage. Anilox roll 136 used to apply the second layer of ink 120 has an anilox roller volume of approximately 47 bcm that results in approximately 90% coverage. Other embodiments utilize different anilox roller volumes which may result in different coverage amounts.

Figure 3:
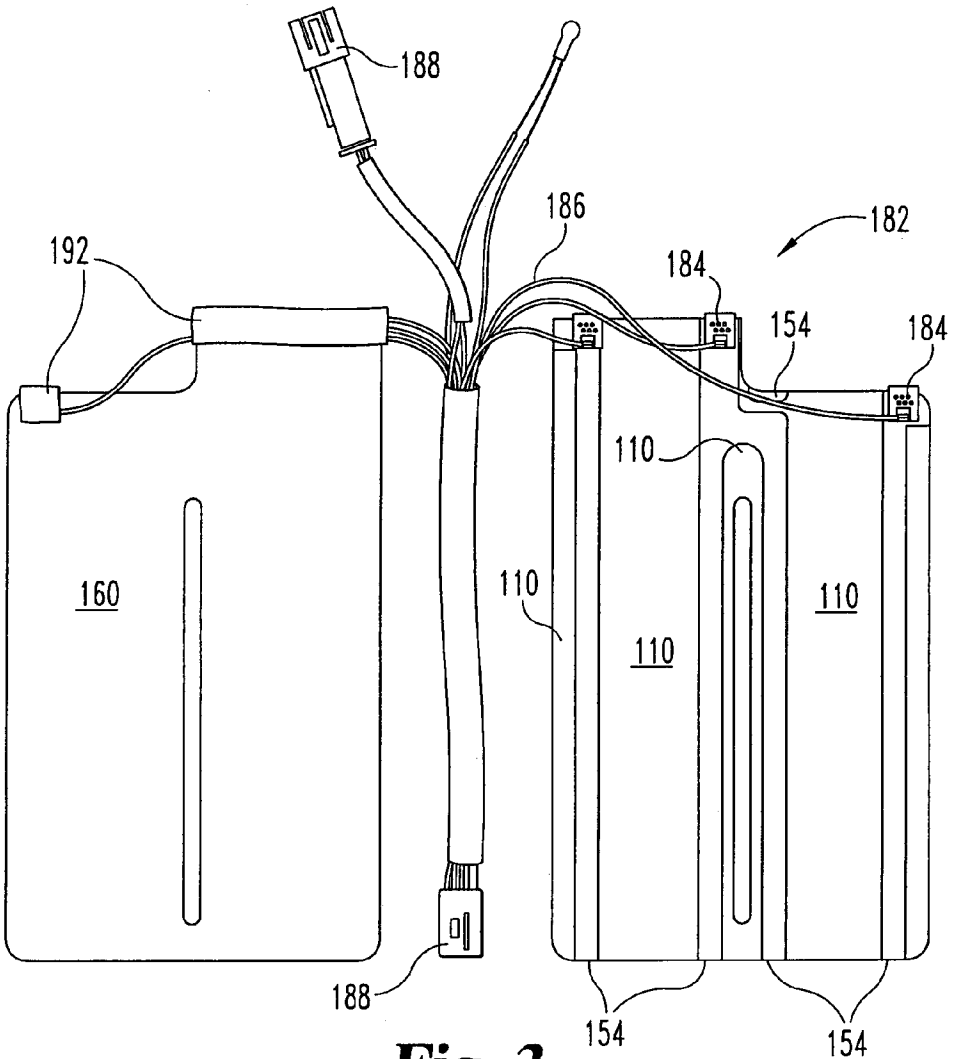
FIG. 3 is a top plan view of a flexible film heater with a substrate and ink pattern manufactured according to the embodiment depicted in FIG. 1.

Depicted in FIG. 3 is flexible film heater 118 manufactured according to one embodiment of the present invention. In the illustrated embodiment, the left hand portion of film heater 118 (depicted as covered by adhesive layer 160 and protective coverings 192) is used as an automotive seat cushion heater segment while the right hand portion of film heater 118 (depicted with adhesive layer 160 and protective coverings 192 removed) is used as an automotive seat back heater segment. In the illustrated embodiment, flexible film heater 118 includes conductive substrate 110, at least one printed conductive element, for example, electrode conductor 154, and at least one thin film insulating Polyimide or Polymer layer, for example, adhesive layer 160. The assembly of heater 118 includes separating conductive substrate 110 at perforations 180 and connecting electrical clips 184 to electrode conductors 154. Electrical clips 184 are in electrical communication with at least one of the top layer of ink in electrode conductors 154, the bottom layer of ink in electrode conductors 154, or conductive substrate 110. Wires 186 are attached to clips 184 and are further attached to connectors 188, which can provide for connection to a power source, for example, an automobile electrical system. Adhesive layer 160 covers the surface of substrate 110 and includes a peel-a-way layer (not depicted) that may be removed to expose the adhesive prior to attaching heater 182 to a desired article. Protective coverings 192 are placed over electrical clips 184 to protect heater 182 and electrical clips 184 from damage.

Figure 4:
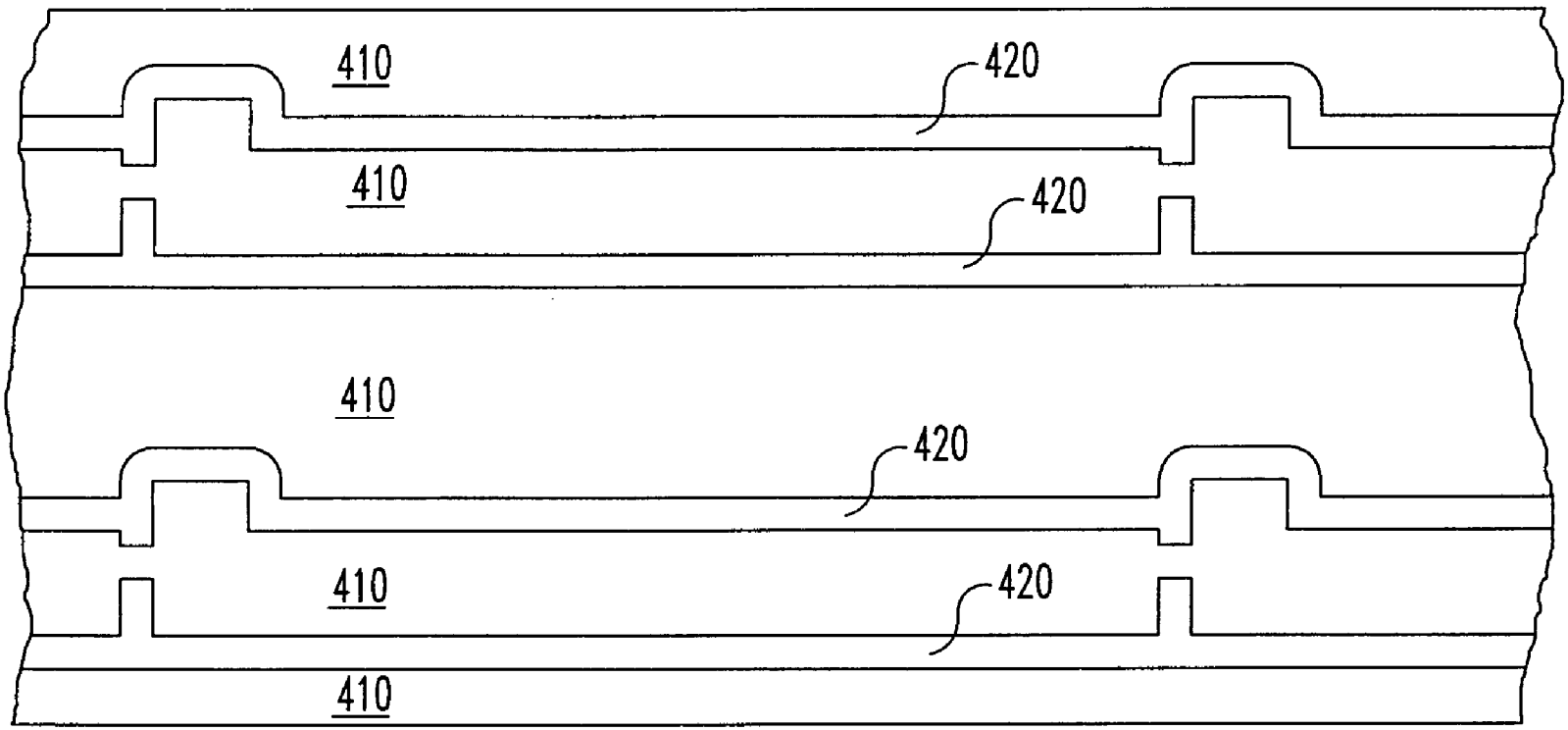
FIG. 4 is a top plan view of a substrate with an ink pattern manufactured according to another embodiment of the present invention.

Depicted in FIG. 4 is a conductive substrate 410 printed with an alternate pattern of electrode conductors 420 according to another embodiment of the present invention. Electrode conductors 420 are in electrical communication with conductive substrate 410, and the ink pattern is repetitive along substrate 410. In the illustrated embodiment, the electrode conductor pattern is generally suitable for forming liquid reservoir heaters, for example, water tank heaters.

In further embodiments of the flexible heater, a controller circuit is integrated with the heater to limit the electrical current flowing to the heater when certain conditions, such as a maximum temperature, are met during operation. The controller is typically flexible, although a rigid controller may also be used. The controller includes at least one location where it is functionally connected to the conductive traces and/or the substrate, with the remainder of the controller being insulated from the conductive traces and/or the substrate. Alternate embodiments of the heater control incorporate printed conductors to facilitate component attachment and subsequent connections to the film substrate as well as circuit continuity.

Various techniques may be employed to construct a heating element with an attached controller circuit, for example, flexographic, stencil printing, and syringe dispensing techniques. Additionally, the controller circuits may be fabricated using flexographic, stencil printing, syringe dispensing, or other appropriate techniques. Furthermore, the controller circuits may be attached to the heating elements using stencil printing, syringe dispensing, or other appropriate techniques. Frequently, syringe dispensing techniques are used to apply conductive material, such as a conductive adhesive or conductive ink, when the conductive material is expected to operate under relatively heavy current loads. Stencil printing techniques are frequently used to apply a predetermined thickness of conductive material, such as conductive adhesive or conductive ink, when lighter electrical current loads are expected.

Figure 5:
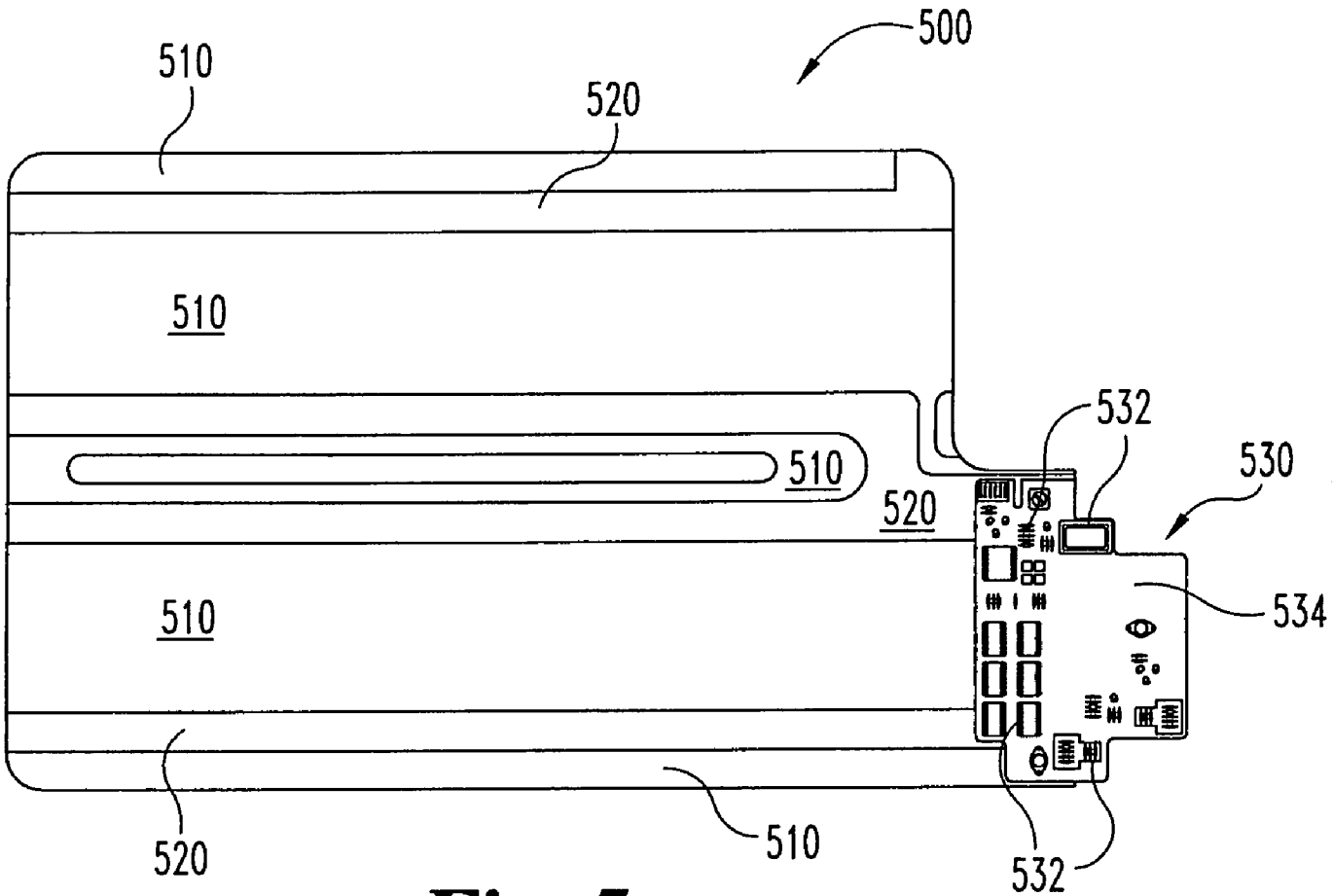
FIG. 5 is a top plan view of a heating element with a controller manufactured according to yet another embodiment of the present invention.

In the example embodiment depicted in FIG. 5, flexible heater 500 is formed by applying a silver ink to a carbon impregnated Kapton® substrate 510 using an automated printing technique, for example, flexographic printing. After curing, the silver ink forms conductors 520. Controller 530 is formed by attaching the controller circuit components 532 to flexible circuit board 534 using a conductive adhesive and a stencil printing technique. Flexible circuit 534 board is then connected to conductive substrate 510 and/or conductors 520 using a conductive adhesive and a stencil printing technique.

Figure 6:
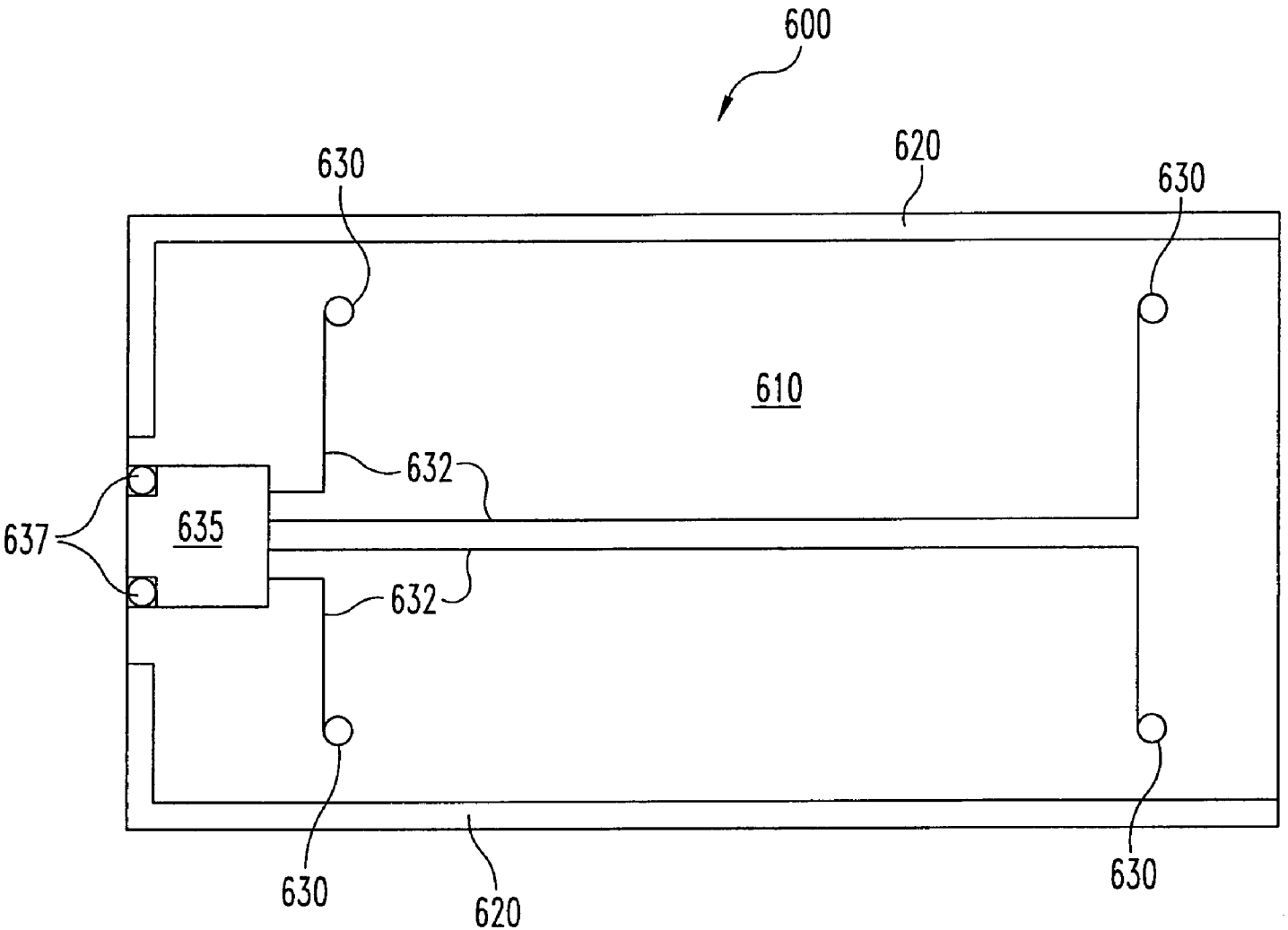
FIG. 6 is a top plan view of a heating element with a controller according to still a further embodiment of the present invention.

In the example embodiment depicted in FIG. 6, flexible film heater 600 includes conductive substrate 610, conductors 620, and at least one thermal sensor, for example thermistor 630, for detecting the temperature of the body being heated by the heater. Thermistors 630 are connected to connectors 632 and are used as inputs to the controller 635 in order to regulate the film heater to achieve a desired body temperature. Controller 635 is further connected to conductive substrate 610. In alternate embodiments, controller 635 is connected to conductors 620.

Figure 7:
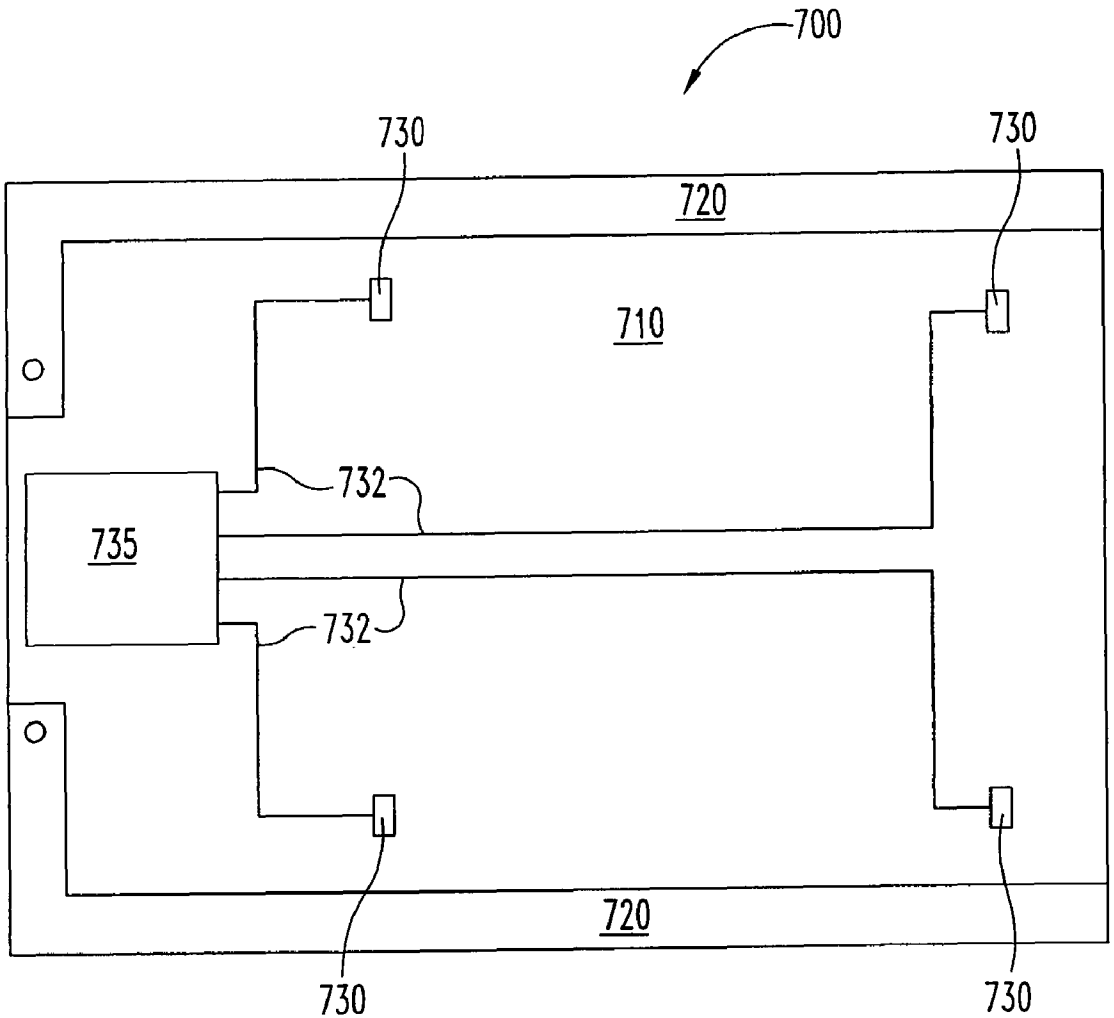
FIG. 7 is a top plan view of a heating element with a controller according to yet a further embodiment of the present invention.

FIG. 7 depicts a flexible film heater 700 that includes conductive substrate 710, conductors 720, and at least one thermal sensor, for example, thermistor 730, for detecting the temperate of the body being heated by the heater. Thermistors 730 are connected to connectors 732 and are used as inputs to controller 735 in order to regulate the film heater to achieve a desired body temperature. Controller 735 is further connected to conductive substrate 710. In alternate embodiments, controller 735 is connected to conductors 620.

Figure 8:
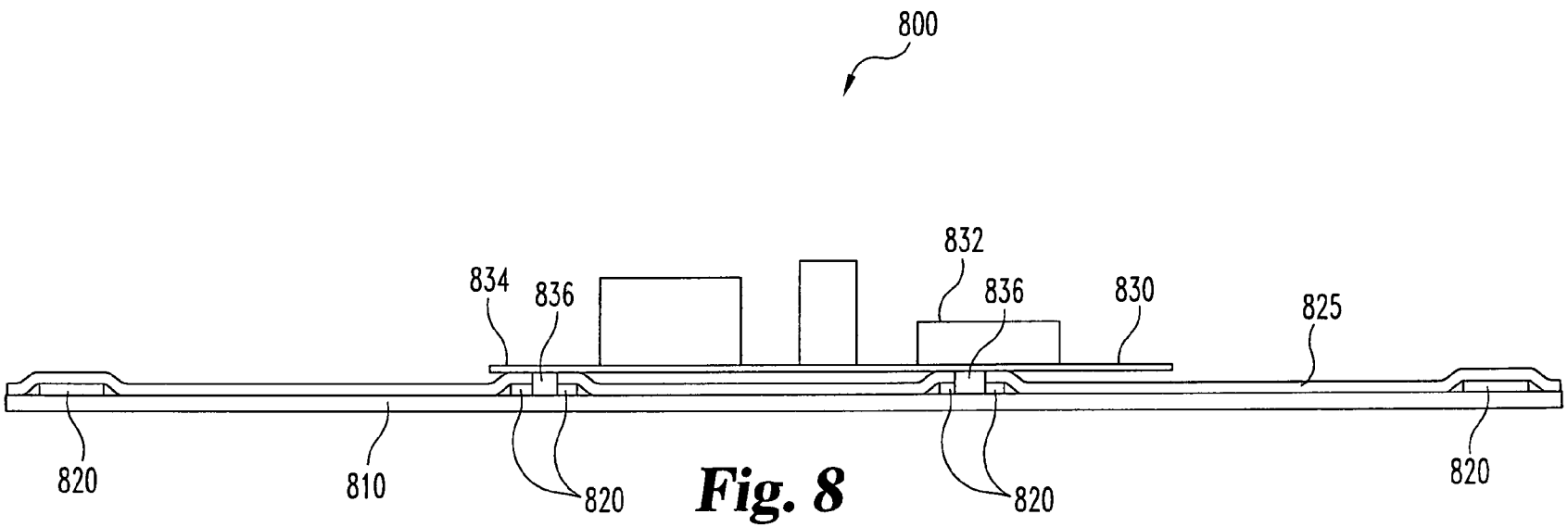
FIG. 8 is a side elevational view of a heating element with a controller according to another embodiment of the present invention.

In the example embodiment, depicted in FIG. 8, flexible film heater 800 includes conductive substrate 810, insulating layer 825, conductors 820, and controller 830. Controller 830 further includes components 832 mounted to controller substrate 834, and connectors 836. Connectors 836 functionally connect controller 830 to substrate 810 and conductors 820. In alternate embodiments, at least one connector 836 is connected only to conductors 620, while in still other embodiments at least one connector 836 is connected only to substrate 810.

Still another example embodiment of the flexible heater provides a seat heater with an integrated surface mount technology electronic circuit board capable of controlling at least one independent temperature region(s) on a conductive film heater element. In alternate embodiments, at least four independent temperature regions are controlled. The control circuit used in this embodiment may be fabricated on an approximately 0.010 inch thick flexible Polyimide substrate and provides an input connection from the thermistors and an output connection to the film heater element. The control circuit will frequently process signals from the temperature sensor (inputs) and provide a single controlled output voltage to the heating element. The controller operates, at least in part, to prevent thermal run-away of a constant wattage film heater.

In yet another example embodiment, a seat heater includes at least one independent thermal sensor, for example four thermal sensors, mounted on each carbon conductive flexible heating pad. One pad can be located on the occupant seat bottom with the other pad located on the occupant seat back. Each pad is controlled independently of the other pad. The maximum temperature of each pad is limited to, for example, 85 degrees centigrade. When the temperature at any single sensing location exceeds the maximum temperature set point, the primary lead to the individual heater element is opened. Operation is restored to the respective heater when the temperature at all four sensors is below the recovery hysteresis value of, for example, 80 degrees centigrade.

Certain embodiments of the flexible heater include positive temperature coefficient ("PTC") thermistors—thermally sensitive semiconductor resistors that exhibit an increase in resistance with an increase in temperature. A change in the resistance of a PTC thermistor can be brought about either by a change in the ambient temperature or internally by self heating resulting from current flowing through the heater. Typically, the PTC thermistors exhibit an increase in resistance proportional to the increase in temperature, although other thermistor types may be used. One example thermistors used in certain embodiments is a pre-packaged SOT-23 device.

In a further example embodiment flexible heater, an insulating layer is placed over a flexible heating element. At least one temperature sensor, for example a thermistor, a circuit controller, and electrical connectors between the temperature sensor(s) and the controller are mounted on top of the insulating layer. The circuit board inputs are connected to the temperature sensor(s) using printed silver conductors, insulated lead wires, or other suitable electrical connectors. Typically, each temperature sensor consists of a precision sensing device capable of withstanding the thermal and mechanical stresses associated with the application. A connection between the controller and the electrodes and/or substrate of the heating element is also provided. The flexible circuit board may be attached to the film heater with rivets or other suitable interconnect and is capable of providing continuous thermal management whenever power is applied to the seat heater. In alternate embodiments, thermistors are printed directly on the flexible substrate of the heating element.

In alternate embodiments, electrode conductor patterns on a conductive substrate can be established on the basis of emission and power dissipation requirements. Wiring with comparable current carrying ability can then be attached to complete the temperature control circuit or be connected to an external non-integrated temperature controller. If no controller is used, then a condition is established that allows free-air heat dissipation to occur. The fail-safe properties of a non-controlled heater embodiment frequently rest on the high temperature characteristics of Kapton® Polyimide film substrate and thermal limitation of the adhesive backing and polymer (silver) printing ink.

A thin film heater manufactured according to one embodiment of the present invention was examined, at least in part, using scanning electron microscope photographs of the silver micro-spheres. The photographs revealed that a very smooth surface with a small-scale, rough structure uniformly distributed over the surface was achieved. Also revealed was that some erosion of small particles and occasional ejection of larger "flakes" from the film may occur during operation. Additionally, various fiber-like structures were frequently visible on the film that are representative and common with silver ink formulations.

Yet another embodiment provides a conductive article including at least two thin conductive film layers adjacent to one another, wherein materials in the thin films are selected to provide a substantial thermal difference between the adjacent films resulting in a thermal curtain or isolation effect.

While many of the recited embodiments are for single materials, the extension to multilayer films is straightforward. The overall material selection process can take into account the various considerations (for example, film thickness, adhesive tack, silver cross sectional area and conductivity) in an optimal design to obtain a particular desired objective, such as, for optimal production of a certain thermal mass range of products, or for optimal thermal energy production, or for a combination of the two.

Still another embodiment provides for film/wire termination crimps utilizing application-specific crimping terminals and actuation levers using a pneumatic actuated press to secure the termination sites.

While example embodiments of the invention have been illustrated and described in detail in the drawings and foregoing description, the same is to be considered as illustrative and not restrictive in character, it being understood that only the example embodiments have been shown and described and that all changes and modifications that come within the spirit of the invention are desired to be protected. Dimensions are not intended to be limiting and may be altered as would be understood by one of ordinary skill in the art.

What is claimed is:

1. A method for manufacturing a flexible heater, comprising:

providing a supply of flexible and electrically conductive substrate;

providing a liquid ink;

advancing said substrate to a first printing location;

applying a first layer of said ink in a first pattern to said substrate at the first printing location;

partially curing said first layer of ink with heat;

advancing said substrate to a second printing location different from the first printing location;

applying a second layer of said ink in a second pattern to said substrate at the second printing location, wherein said second layer of ink substantially overlies the first layer of ink;

forming at least one electrically conductive electrode by fully curing said first and second layers of ink with heat, wherein the at least one electrically conductive electrode is in electrical communication with said substrate; and forming a flexible heater, wherein said substrate generates heat as electrical current flows from said at least one electrode and through said substrate.

2. The method of claim 1, further comprising severing said substrate into at least two separated portions.

3. The method of claim 1, wherein said first and second patterns are substantially identical.

4. The method of claim 1, wherein said supply of substrate is wound in a coil.

5. The method of claim 1, wherein said partially curing and said fully curing are performed by at least one heat lamp.

6. The method of claim 1, further comprising:

attaching electrical wires to at least said second layer of cured conductive ink, wherein the wires are in electrical communication with at least said second layer of cured conductive ink.

7. The method of claim 6, further comprising:

generating an electrical current flowing between said substrate and said at least one electrode; and generating heat in said substrate due to a resistance in said substrate.

8. The method of claim 6, further comprising:

attaching the electrical wires to an automobile electrical system.

9. The method of claim 1, wherein said supply of substrate comprises carbon impregnated polyimide film.

10. The method of claim 1, wherein:

said applying a first layer of said ink in a first pattern to said substrate at the first printing location includes using a flexographic printing technique; and said applying a second layer of said ink in a second pattern to said substrate at the second printing location includes using a flexographic printing technique.

11. The method of claim 10, further comprising perforating said substrate into at least two separable portions.

12. The method of claim 10, wherein said first and second layers of ink are printed in substantially identical patterns.

13. The method of claim 10, wherein said supply of substrate is wound in a coil.

14. The method of claim 10, wherein said advancing said substrate to a first printing location and said advancing said substrate to a second printing location each further include advancing said substrate at approximately fifty (50) feet per minute with respect to the first and second printing locations.

15. The method of claim 1, further comprising:

providing at least one anilox roll;

wherein said applying a first layer of said ink in a first pattern to said substrate at the first printing location includes using the at least one anilox roll; and wherein said applying a second layer of said ink to said substrate at the second printing location includes using the at least one anilox roll, and said second layer of ink substantially overlies said partially cured first layer of ink.

16. The method of claim 15, further comprising perforating said substrate into at least two separable portions.

17. The method of claim 16, wherein said first and second layers of ink are printed in substantially identical patterns.

18. The method of claim 17, wherein said partially curing and said fully curing are performed by at least one heat lamp.

19. The method of claim 18, wherein said supply of substrate is wound in a coil.

20. The method of claim 19, further comprising:

attaching electrical wires to at least said second layer of cured conductive ink, wherein the wires are in electrical communication with at least said second layer of cured conductive ink.

21. The method of claim 20, wherein said advancing said substrate to a first printing location and said advancing said substrate to a second printing location each further include advancing said substrate at approximately fifty (50) feet per minute with respect to the first and second printing locations.

22. The method of claim 1, wherein said at least one conductive electrode includes a first conductive electrode and a second conductive electrode, said first and second conductive electrodes being in electrical communication with said substrate, and wherein said substrate is adapted to generate heat as electricity flows from said first electrode, through said substrate, and to said second electrode.

23. The method of claim 1, wherein said substrate heats to eighty-five (85) degrees centigrade when electrical current flows from said at least one electrode through said substrate.

* * * * *